US012233446B2

(12) United States Patent
Shinbata

(10) Patent No.: US 12,233,446 B2
(45) Date of Patent: Feb. 25, 2025

(54) CAN BODY FORMING DEVICE

(71) Applicant: TOYO SEIKAN CO., LTD., Tokyo (JP)

(72) Inventor: Kazuhiro Shinbata, Kanagawa (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 227 days.

(21) Appl. No.: 17/774,286

(22) PCT Filed: Aug. 14, 2020

(86) PCT No.: PCT/JP2020/030889
§ 371 (c)(1),
(2) Date: May 4, 2022

(87) PCT Pub. No.: WO2021/095309
PCT Pub. Date: May 20, 2021

(65) Prior Publication Data

US 2022/0388051 A1 Dec. 8, 2022

(30) Foreign Application Priority Data

Nov. 11, 2019 (JP) ..... 2019-204285

(51) Int. Cl.
*B21D 22/26* (2006.01)
*B21D 22/28* (2006.01)
*B21D 51/26* (2006.01)

(52) U.S. Cl.
CPC ..... *B21D 22/26* (2013.01); *B21D 22/28* (2013.01); *B21D 51/26* (2013.01)

(58) Field of Classification Search
CPC ..... B21D 22/26; B21D 22/28; B21D 51/26
See application file for complete search history.

(56) References Cited

U.S. PATENT DOCUMENTS 3,771,345 A 11/1973 Paramonoff
2004/0035871 A1 2/2004 Chupak
2015/0013422 A1 1/2015 Hosoi et al.
2017/0095852 A1* 4/2017 Carstens ..... B65D 1/165
(Continued)

FOREIGN PATENT DOCUMENTS

CN 100488660 C 5/2009
CN 204916414 U 12/2015
(Continued)

OTHER PUBLICATIONS

Office Action in corresponding Chinese Application No. 202080069609.8, issued Mar. 16, 2023 and English language translation thereof.
(Continued)

*Primary Examiner* — Teresa M Ekiert
(74) *Attorney, Agent, or Firm* — GREENBLUM & BERNSTEIN, P.L.C.

(57) ABSTRACT

In reforming a can bottom part, the defect of black discoloration in an associated formed portion is suppressed. A forming device for a can body, in which a cylindrical barrel part and a can bottom part are integrally formed, includes a tool used for the can body having a concave dome part in a center of the can bottom part and having an annular leg part on a periphery of the dome part to reform a shape of the leg part. The tool includes a pressing body that is inserted into the can body, and that abuts on an inner surface of the dome part, and a forming die that forms a curved end part heading inward on a lower end part of the leg part.

4 Claims, 10 Drawing Sheets

(56) References Cited

U.S. PATENT DOCUMENTS

| | | | |
|---|---|---|---|
| 2020/0071017 | A1 | 3/2020 | Hirota et al. |
| 2022/0097896 | A1 | 3/2022 | Kobayashi |

FOREIGN PATENT DOCUMENTS

| | | | |
|---|---|---|---|
| CN | 106270266 | A | 1/2017 |
| DE | 2 625 170 | A1 | 12/1977 |
| EP | 2813300 | A1 | 12/2014 |
| JP | 59-25318 | U | 2/1984 |
| JP | 9-285832 | A | 11/1997 |
| JP | 2001-139012 | A | 5/2001 |
| JP | 2013-103246 | A | 5/2013 |
| JP | 2018-103227 | A | 7/2018 |
| WO | 2013/118728 | A1 | 8/2013 |
| WO | 2018/079434 | A1 | 5/2018 |
| WO | 2020/158355 | A1 | 8/2020 |

OTHER PUBLICATIONS

Supplementary European Search Report issued Nov. 2, 2023 in corresponding European family member Application No. 20886632.7.

Office Action issued in Indian Patent Application No. 202217024587 dated Aug. 26, 2022, along with English translation thereof.

International Search Report issued in International Patent Application No. PCT/JP2020/030889, dated Sep. 24, 2020, along with an English translation thereof.

Written Opinion of the International Searching Authority issued in International Patent Application No. PCT/JP2020/030889, dated Sep. 24, 2020.

Office Action issued in corresponding Taiwanese Patent Application No. 109133846 dated Oct. 6, 2021, along with English translation thereof.

Office Action issued Sep. 27, 2023 in Chinese family member application No. 202080069609.8, with English language translation thereof.

Office Action issued in corresponding Japanese Application No. 2021-555905 dated Jan. 9, 2024, along with English translation thereof.

Office Action of corresponding Chinese Application No. 202080069609.8, Apr. 16, 2024, as well as English language translation.

Office Action of corresponding Vietnamese Application No. 1-2022-02333, Mar. 13, 2024, as well as English language translation.

Office Action of corresponding Japanese Application No. 2021-555905, Apr. 2, 2024, as well as English language translation.

* cited by examiner

CAN BODY FORMING DEVICE

TECHNICAL FIELD

The present invention relates to a forming device for reforming a can bottom part (bottom) of a can body.

BACKGROUND ART

A can body called a seamless can (alternatively, two-piece can) has a can barrel part, etc., formed by a drawing and ironing process. For such a can body, decrease in the thickness of the can barrel part has been pursued to save resources and reduce weight. To ensure pressure-resistant strength, a concave dome part is formed in a can bottom part, and an annular leg part is formed on a periphery thereof. In addition, a variety of ingenious shapes are designed for a grounding part of the leg part to prevent buckling and the like.

A forming process for the can bottom part includes, as a first stage process, forming a center part thereof into a concave shape to form the dome part and the leg part, and as a second stage process, reforming the leg part. A conventionally-known device for such reforming is provided with a frame serving as a base, a rotation shaft that is supported by the frame and rotationally driven, a turret that is supported by the rotation shaft and has pockets on an outer periphery thereof to hold can bodies, and reform mechanisms that are supported by the rotation shaft and provided to respectively correspond to the pockets, and the reform mechanisms are each provided with a top spindle and a bottom spindle (refer to PTL 1 below).

CITATION LIST

Patent Literature

[PTL 1] Japanese Patent Application Publication No. 2018-103227

SUMMARY OF INVENTION

Technical Problem

In the process of reforming the leg part of the can bottom part according to the conventional art mentioned above, an inner peripheral wall of the annular leg part is pressed using a roller or the like. This harms the oxide film of an aluminum alloy that is a can material, whereby an associated pressed portion is prone to undesired black discoloration at the time of heat sterilization or the like after the contents are filled, and also a complicated maintenance of the forming device occurs due to adhesion of metal material of the can bottom to the roller or the like.

The present invention has been proposed to address such circumstances. That is to say, a problem to be addressed by the present invention is to suppress the defect of black discoloration in an associated formed portion in reforming a can bottom part, enhance the ease of maintenance of a forming device, and so forth.

Solution to Problem

To solve the problem, the present invention is provided with the configuration below.

A can body forming device for forming a can body, in which a cylindrical barrel part and a can bottom part are integrally formed, includes a tool used for the can body having a concave dome part in a center of the can bottom part and having an annular leg part on a periphery of the dome part to reform a shape of the leg part, and the tool includes a pressing body that is inserted into the can body, and that abuts on an inner surface of the dome part, and a forming die that forms a curved end part heading inward on a lower end part of the leg part.

Advantageous Effects of Invention

The present invention having these features suppresses the defect of black discoloration in an associated formed portion in reforming the leg part of the can bottom part, and enhances the ease of maintenance of the forming device.

DESCRIPTION OF EMBODIMENTS

Hereinafter, embodiments of the present invention will be explained with reference to the drawings. In the following explanation, the same sign in different figures denotes a portion of the same function, and redundant explanation in each of the figures is omitted as appropriate.

Figure 1:
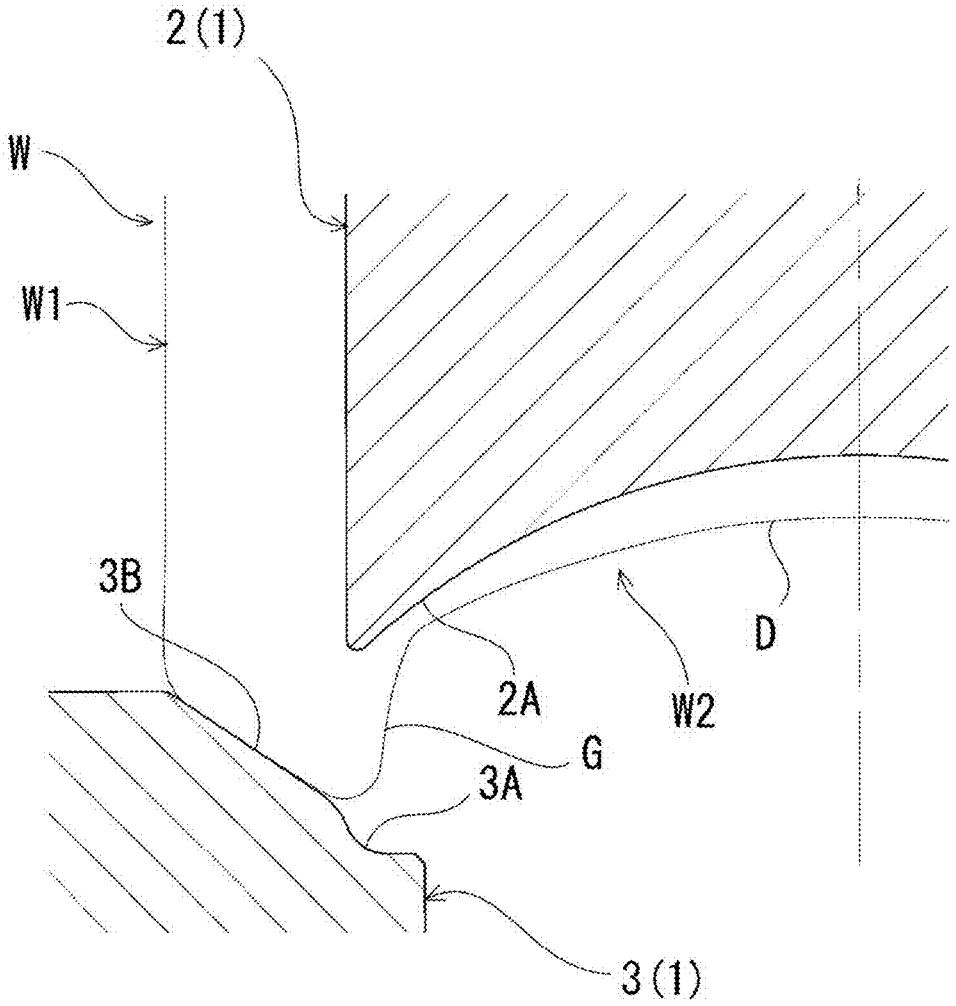
FIG. 1 is a cross-sectional view of a tool in a can body forming device according to the present invention.

As shown in FIG. 1, a can body forming device according to the present invention includes a tool 1 for reforming a leg part G of a can bottom part W2 of a can body (for example, two-piece can) W in which a cylindrical barrel part W1 and the can bottom part W2 are integrally formed. The tool 1 subjects the can body (a primarily-formed can body) having a concave dome part D in a center of the can bottom part W2, and an annular leg part G on the periphery of the dome part D to reforming.

The tool 1 includes a pressing body 2 and a forming die 3. The pressing body 2 is inserted into the can body W, and has an abutting surface 2A that abuts on an inner surface of the dome part D. The forming die 3 has a die part 3A that forms a curved end part Gp (refer to FIG. 6) heading inward on a lower end part of the leg part G, and a tapered part 3B that guides the leg part G to the die part.

Figure 2:
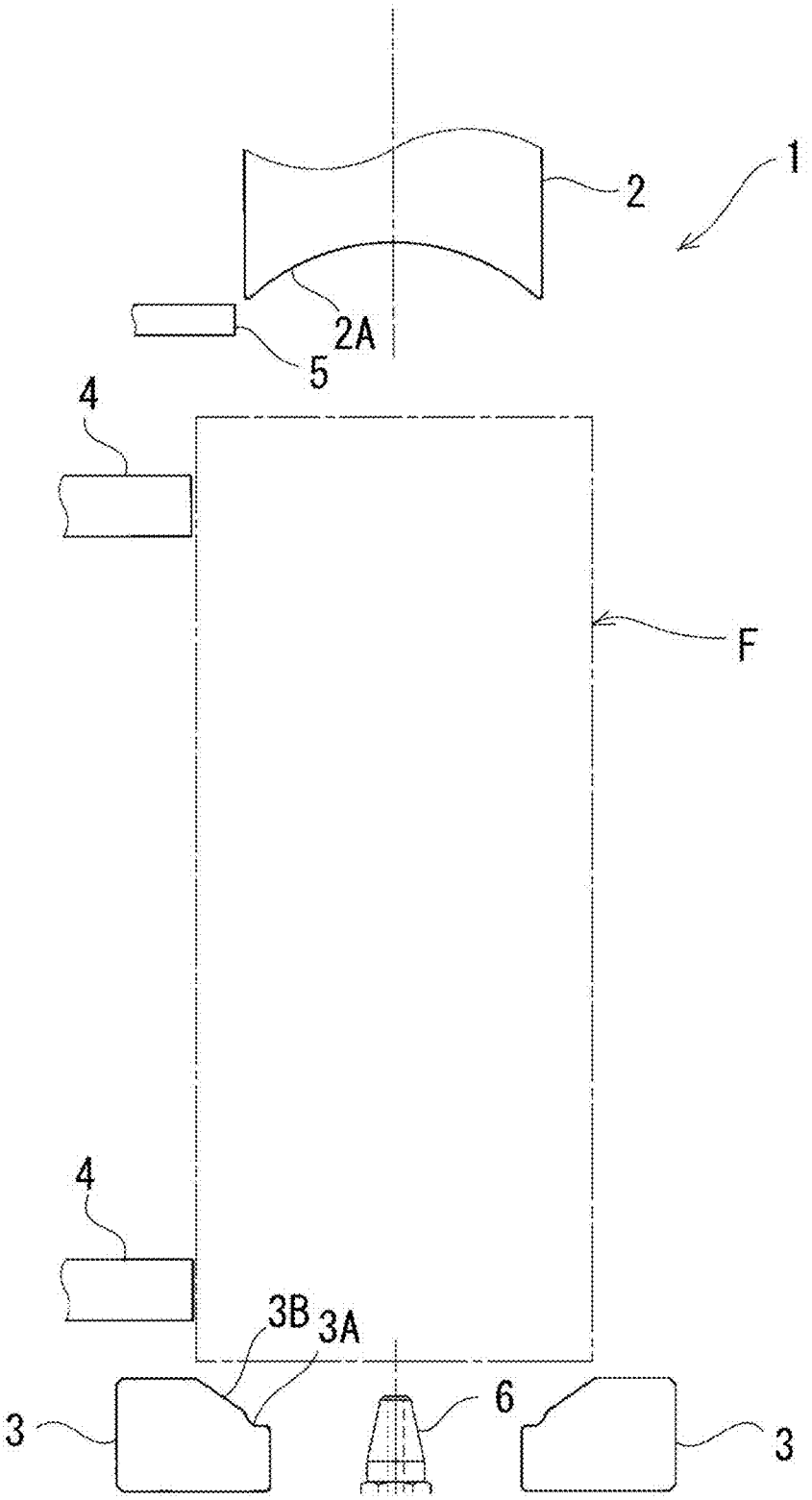
FIG. 2 illustrates one forming process by the can body forming device (starting stroke of a pressing body).

A reforming process using the tool 1 is explained with reference to FIGS. 2 to 8. As shown in FIG. 2, a can body support part 4 and a stop part 5 are provided about the tool 1 composed of the pressing body 2 and the forming die 3. When the pressing body 2 starts a stroke of moving in a direction approaching the forming die 3, the pressing body 2 is positioned outside a receiving area F for the can body W. In addition, an air jetting part 6 is provided in a center part of the forming die 3.

Figure 3:
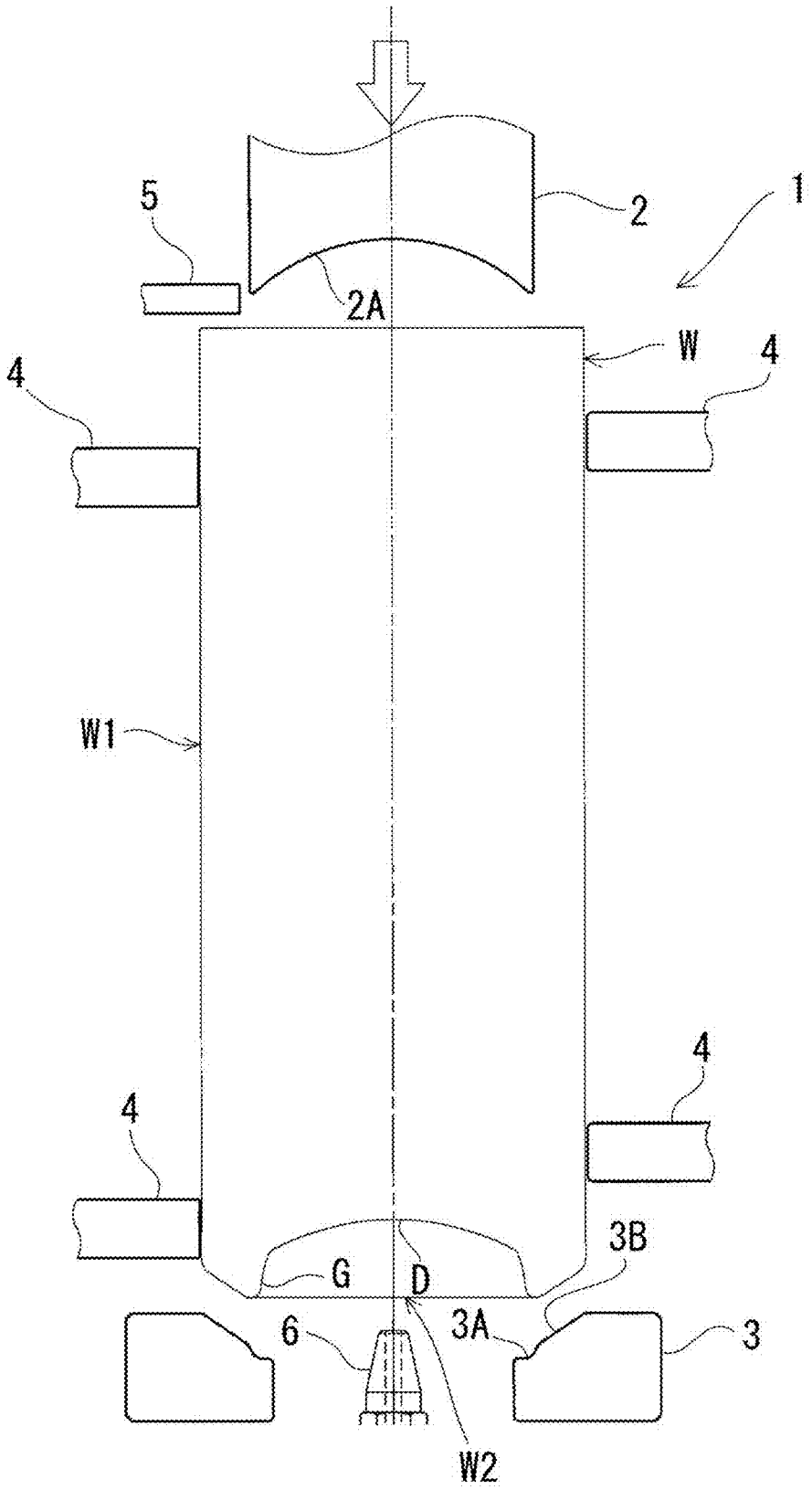
FIG. 3 illustrates one forming process by the can body forming device (receiving a can body).

As shown in FIG. 3, once the can body W is received in the receiving area F, the cylindrical barrel part W1 of the can body W is supported by the can body support part 4 provided about the receiving area F. In the meantime, the pressing body 2 continues moving in the direction of the arrow, and after the can body W is received, the pressing body 2 is inserted into the can body W.

Figure 4:
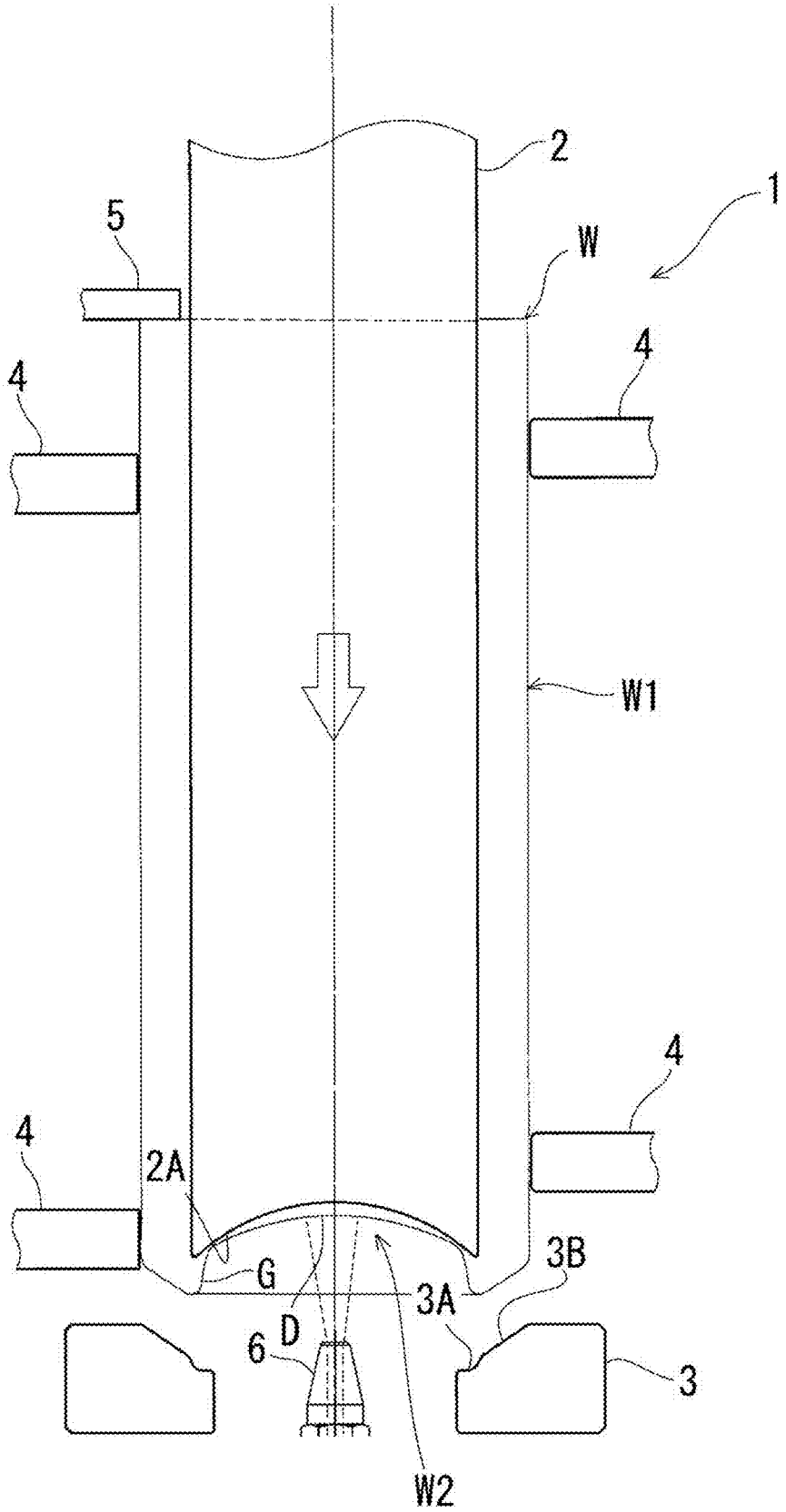
FIG. 4 illustrates one forming process by the can body forming device (bringing the pressing body and a can bottom part into contact with each other).

As shown in FIG. 4, when the pressing body 2 is further moved in the direction of the arrow to cause the abutting surface 2A of the pressing body 2 to abut on the inner surface of the dome part D of the can bottom part W2, air is jetted from the air jetting part 6 toward the outside of the dome part D. This jet of air allows the dome part D of the can bottom part W2 to abut in a stable state on the abutting surface 2A of the pressing body 2.

Figure 5:
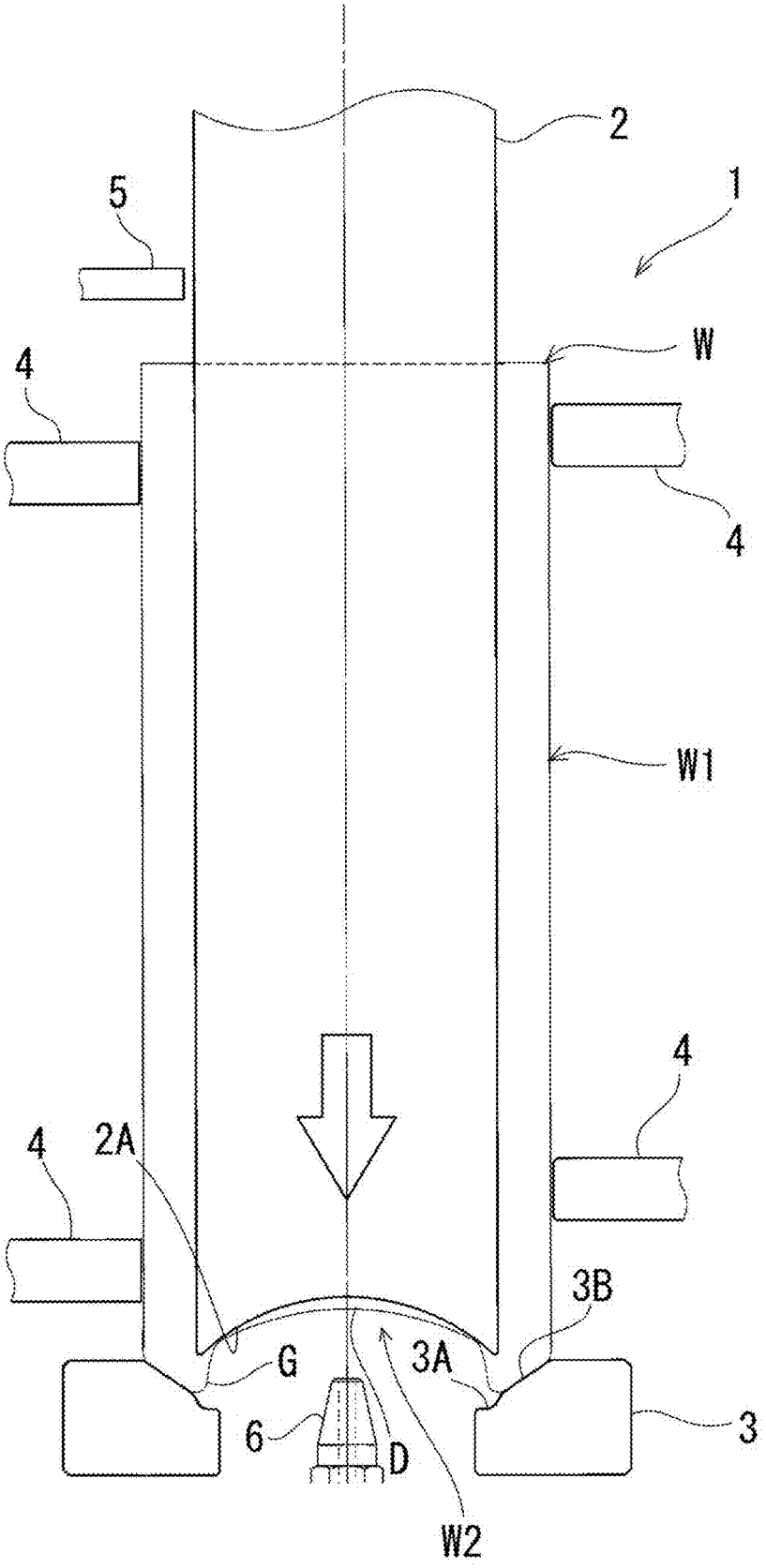
FIG. 5 illustrates one forming process by the can body forming device (starting forming).
Figure 6:
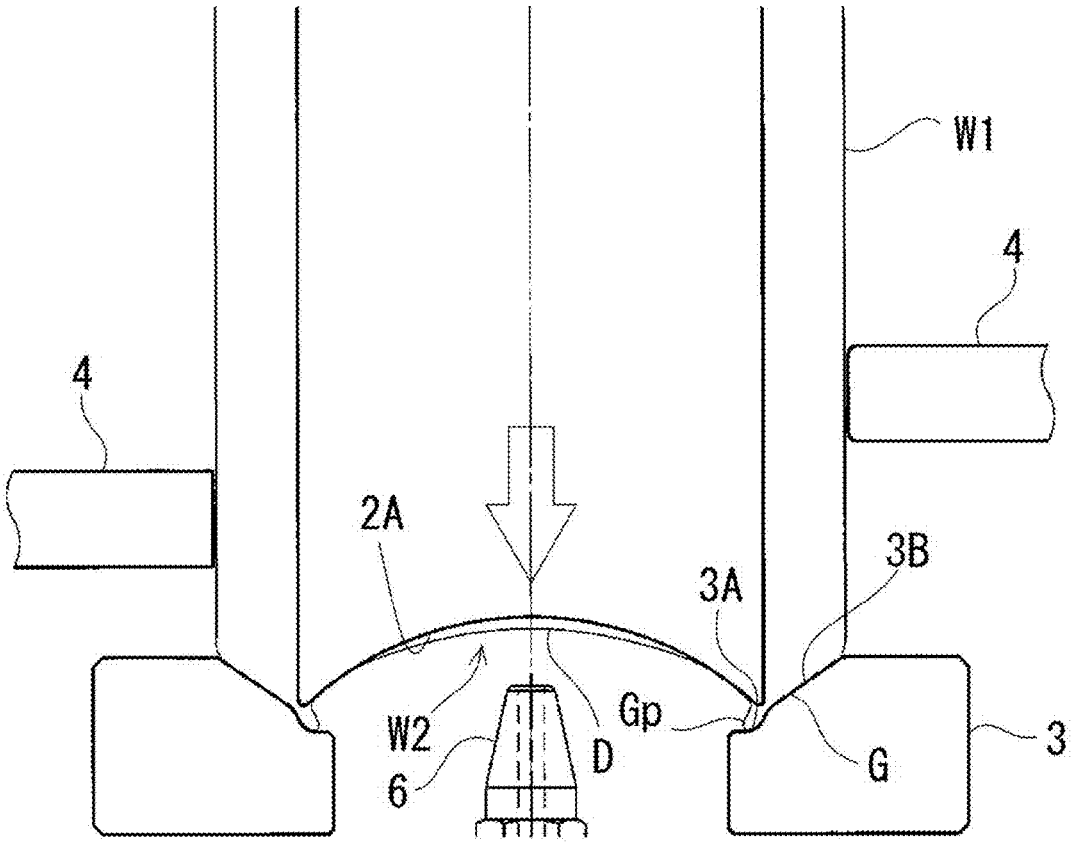
FIG. 6 illustrates one forming process by the can body forming device (ending forming).

Then, as shown in FIG. 5, the pressing body 2 is still further moved in the direction of the arrow, so that the can bottom part W2 pressed by the pressing body 2 moves toward the forming die 3. Once the lower end part of the leg part G of the can bottom part W2 is thus pressed on along the tapered part 3B of the forming die 3, the annular leg part G is deformed by the die part 3A to form, as shown in FIG. 6, the curved end part Gp heading inward on the lower end part thereof. Thus the reforming ends.

Figure 7:
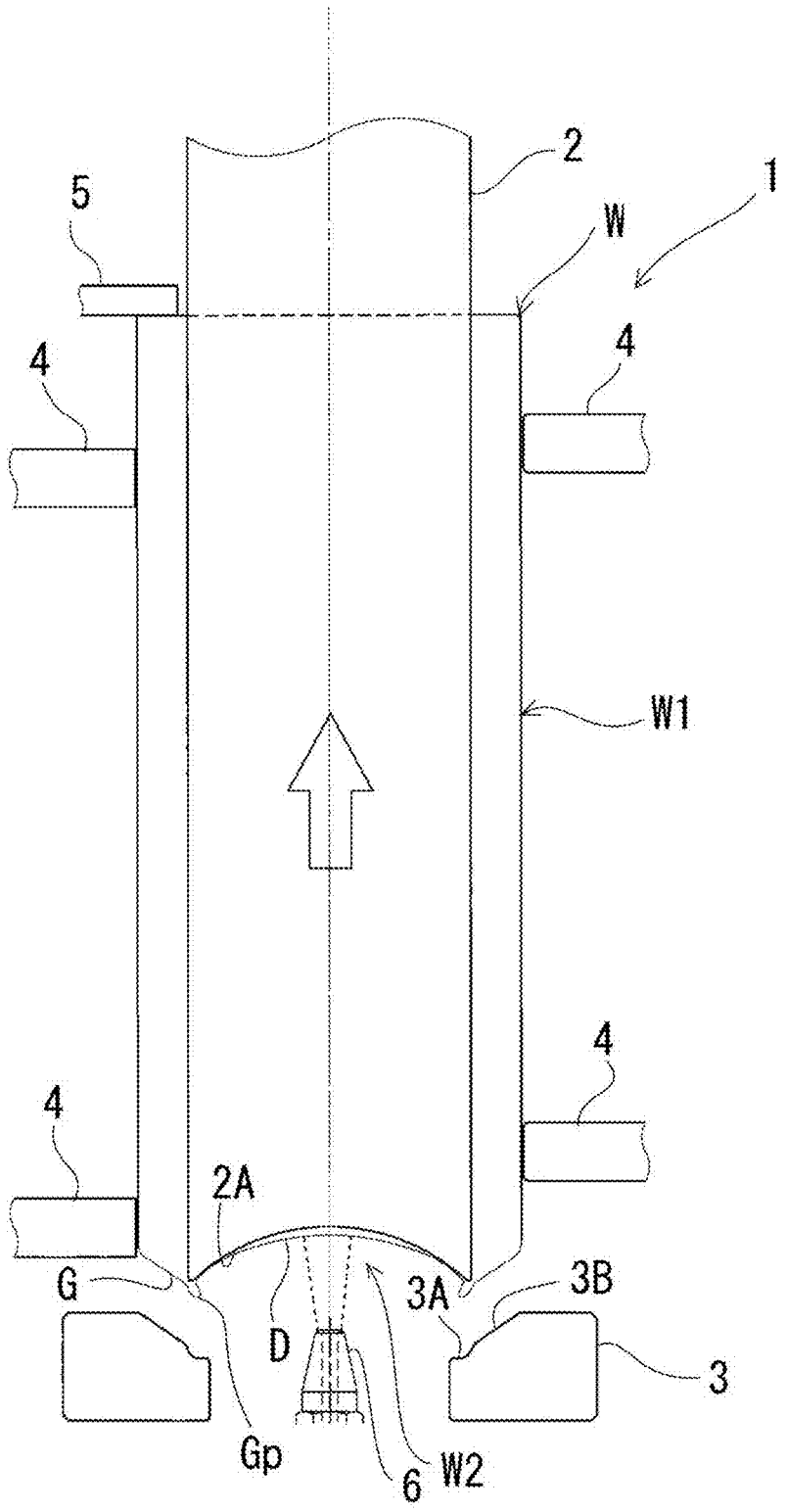
FIG. 7 illustrates one forming process by the can body forming device (jetting air).

Then, as shown in FIG. 7, the can body W that has been subjected to reforming is separated from the forming die 3 by jetting air from the air jetting part 6 while moving the pressing body 2 in a direction heading away from the forming die 3. At this time, with the stop part 5 provided outside the receiving area F in a can axis direction, the can body W receives air jetted from the air jetting part 6 to move to where an upper end part of the can body W abuts on the stop part 5.

Figure 8:
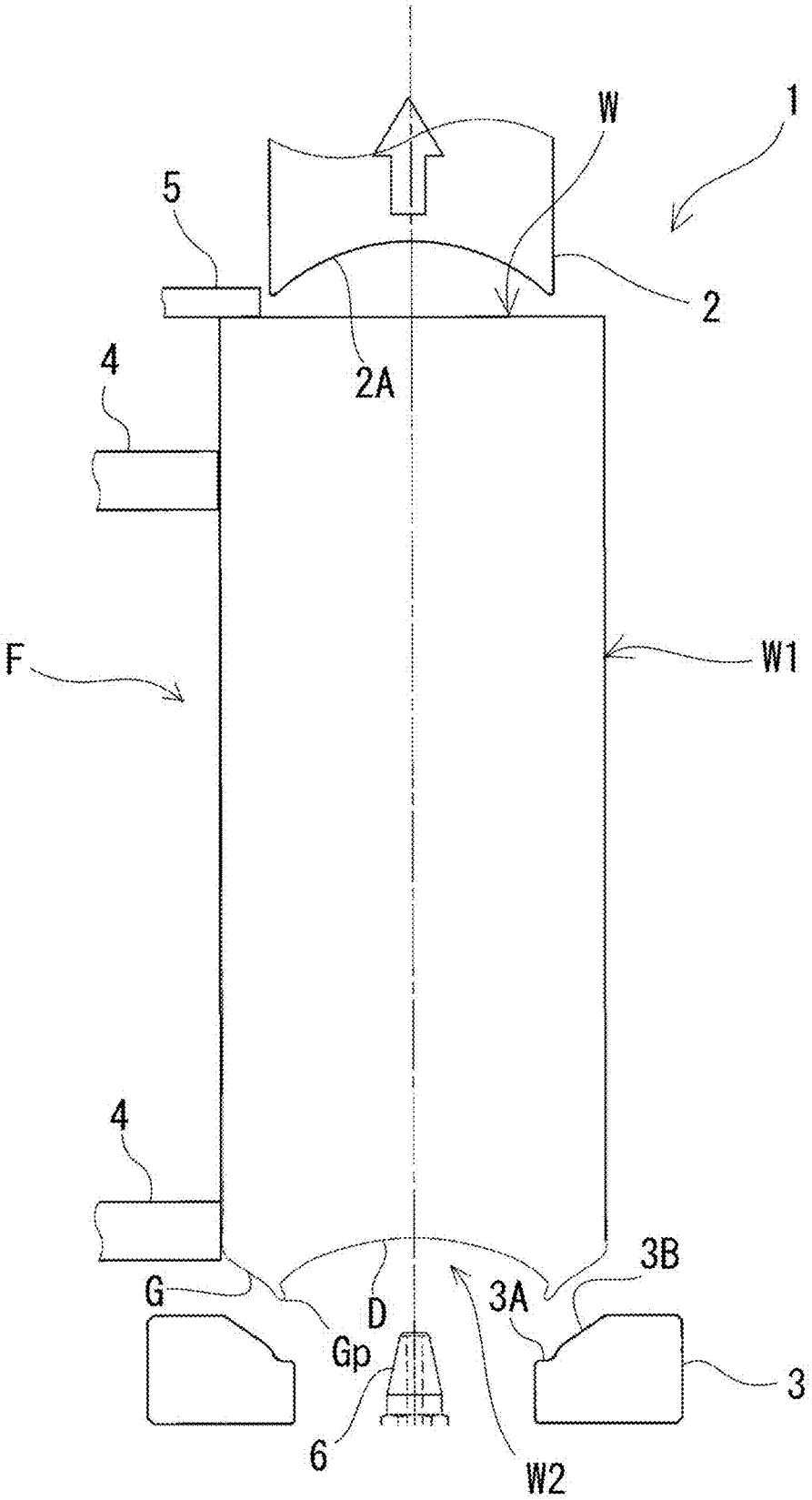
FIG. 8 illustrates one forming process by the can body forming device (transferring the can body).

Still thereafter, as shown in FIG. 8, the pressing body 2 is moved out of the receiving area F, the can body W is taken out of the receiving area F, and then the process goes for the next can body W. This configuration causes little frictional force between the can body W and the forming die 3, unlike the conventional art of making a press using a roller or the like, thus eliminating the accumulation of metal material in the forming die 3.

Figure 9:
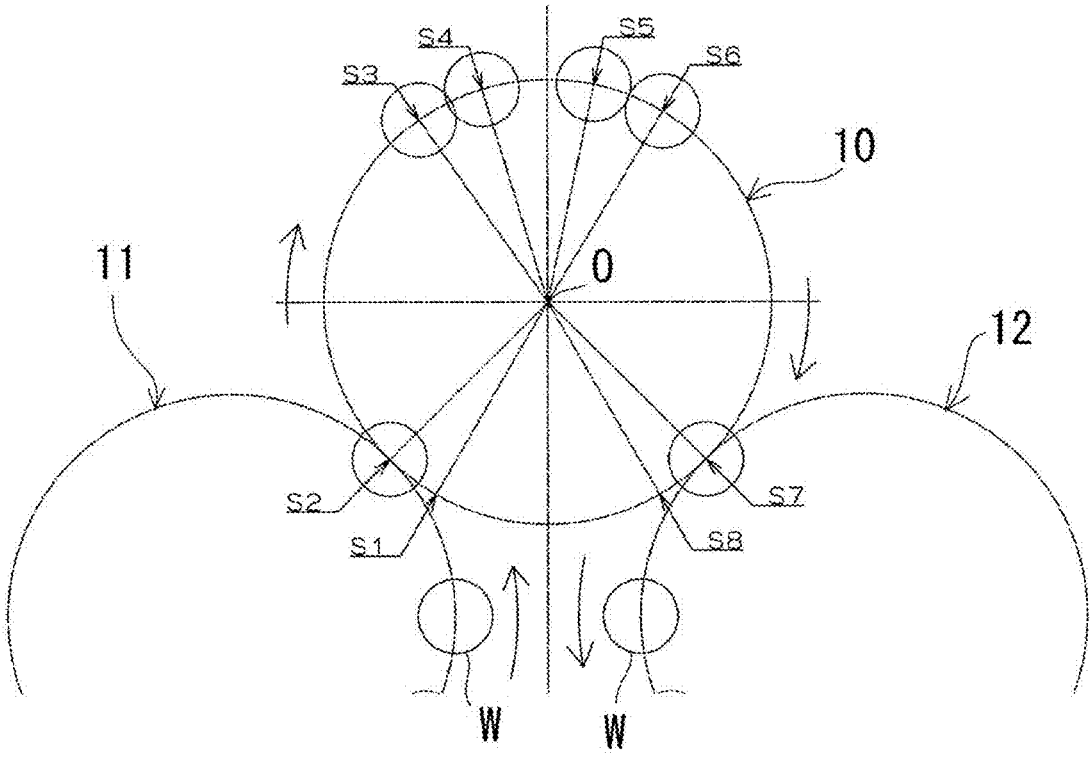
FIG. 9 illustrates process timings in a forming turret.

This series of processes is performed within the span of one rotation of a forming turret 10 as shown in FIG. 9. In an example shown in FIG. 9, from the position of 0°, the movement of the pressing body 2 is started in a rotation position S1 (for example, approximately 30°), the can body W is received in a rotation position S2 (for example, approximately 45°), the abutting surface 2A of the pressing body 2 is caused to abut on the inner surface of the dome part D in a rotation position S3 (for example, approximately 145°), the forming in the forming die 3 is started in a rotation position S4 (for example, approximately 163°), the reforming is ended in a rotation position S5 (for example, approximately 192°), the can body W is moved to the stop part 5 by air jetting in a rotation position S6 (for example, approximately 210°), the can body W is transferred in a rotation position S7 (for example, approximately 315°), and the movement of the pressing body 2 is ended in a rotation position S8 (for example, approximately 330°).

Provided adjacent to the forming turret 10 are a delivering turret 11 and a receiving turret 12 for the can body W. The delivering turret 11 delivers the can body W that has yet to be reformed (after primarily formed) to the forming turret 10 in the rotation position S2, and the receiving turret 12 receives the reformed can body W in the rotation position S7.

Figure 10:
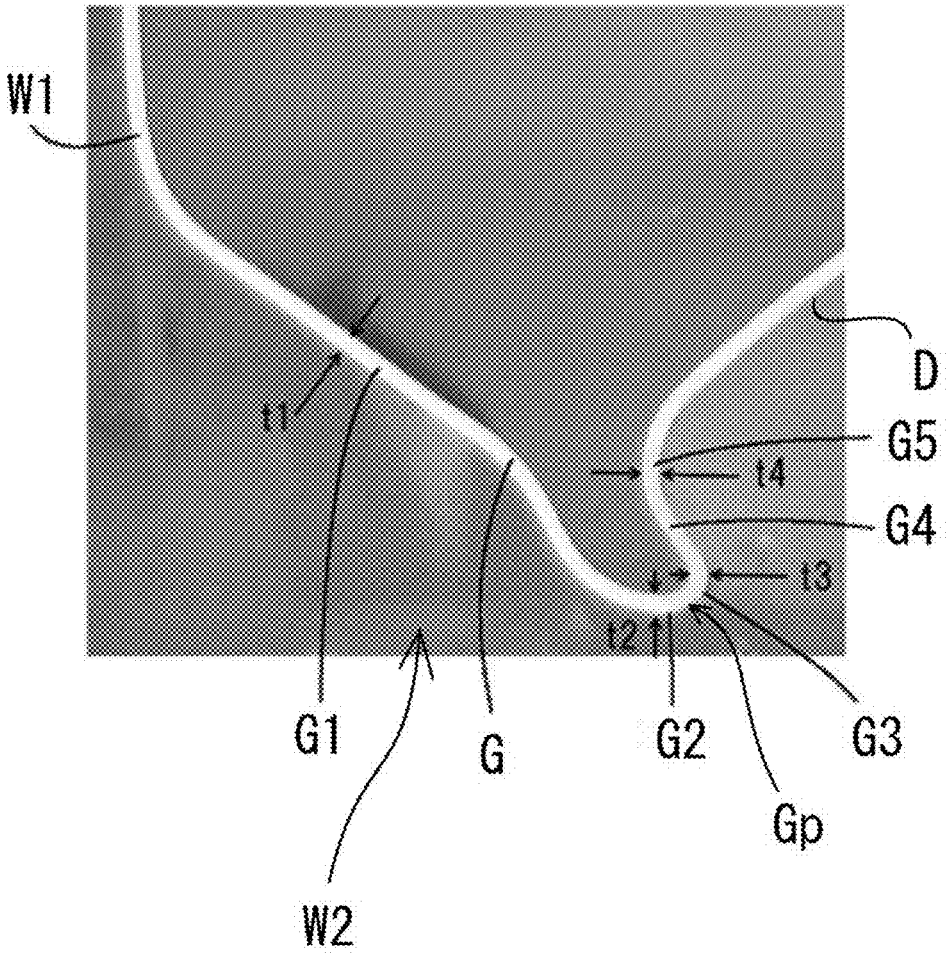
FIG. 10 is a cross-sectional view of the can bottom part of the reformed can body.

Such a can bottom part W2 of the can body W reformed by the tool 1 is formed such that the curved end part Gp as curved inward is formed in the leg part G. More specifically, as shown in FIG. 10, the leg part G of the can bottom part W2 has an outer leg part G1, a grounding end part G2, an inner end part G3, an inclined rising part G4, and an inner leg part G5. The curved end part Gp is formed of the grounding end part G2, the inner end part G3, and the inclined rising part G4.

In this regard, the inside of the curved end part Gp is connected to the periphery of the dome part D at the inner leg part G5, via the inclined rising part G4, from the inner end part G3, and is formed such that the inner leg part G5 has a greater inner diameter than the inner end part G3. In FIGS. 10, t1 to t4 indicate the plate thickness of each part.

As explained above, in reforming the leg part G of the can bottom part W2 in accordance with the embodiment of the present invention, the forming by abutting a roller or the like is eliminated, thus suppressing the defect of black discoloration in an associated formed portion. In addition, metal of the leg part G is not accumulated in the tool 1, thus enhancing the ease of maintenance of the forming device. Meanwhile, although the described embodiment exhibits an example in which the pressing body 2 is moved with respect to the forming die 3, the forming die 3 may contrariwise be moved with respect to the pressing body 2.

REFERENCE SIGNS LIST

1 Tool
2 Pressing body
3 Forming die
4 Can body support part
5 Stop part
6 Air jetting part
10 Forming turret
2A Abutting surface
3A Die part
3B Tapered part
W Can body
W1 Cylindrical barrel part
W2 Can bottom part
D Dome part
G Leg part
G1 Outer leg part
G2 Grounding end part
G3 Inner end part
G4 Inclined rising part
G5 Inner leg part
Gp Curved end part
F Receiving area

What is claimed is:

1. A can body forming device for forming a can body in which a cylindrical barrel part and a can bottom part are integrally formed, the can body forming device comprising:

a tool used for the can body having a concave dome part in a center of the can bottom part and having an annular leg part formed on a periphery of the dome part to reform a shape of the leg part, wherein the tool includes: a pressing body that is inserted into the can body, and that abuts on an inner surface of the dome part; and a forming die that forms a curved end part heading inward on a lower end part of the leg part, and wherein an air jetting part for causing the can bottom part to abut on an abutting surface of the pressing body is provided in a center part of the forming die.

2. The can body forming device according to claim 1, further comprising:

a can body support part that supports a periphery of the cylindrical barrel part; and a stop part that receives an upper end of the can body when the can body that has the formed curved end part is separated from the pressing body.

3. The can body forming device according to claim 2, further comprising:

a forming turret including, about a rotation axis, multiple pairs each composed of the pressing body and the forming die.

4. The can body forming device according to claim 1, further comprising:

a forming turret including, about a rotation axis, multiple pairs each composed of the pressing body and the forming die.

* * * * *